US005297700A

United States Patent [19]

Burrows et al.

[11] Patent Number: 5,297,700

[45] Date of Patent: Mar. 29, 1994

[54] BOTTLED WATER STATION WITH REMOVABLE RESERVOIR

[75] Inventors: Bruce D. Burrows, Valencia, Calif.; Louis M. Busick, Columbus, Ohio

[73] Assignee: Ebtech, Inc., Columbus, Ohio

[21] Appl. No.: 100,296

[22] Filed: Aug. 2, 1993

[51] Int. Cl.[5] ..... B67D 5/62

[52] U.S. Cl. ..... 222/146.6; 62/390; 222/185

[58] Field of Search ..... 222/146.6, 146.1, 130, 222/185; 62/390–395

[56] References Cited

U.S. PATENT DOCUMENTS

| | | | |
|---|---|---|---|
| 2,647,378 | 8/1953 | Rabjohn | 62/394 X |
| 2,657,554 | 11/1953 | Hull | 222/146.1 X |
| 2,744,660 | 5/1956 | Jacobs | 222/146.1 X |
| 3,255,609 | 6/1966 | Jacobs et al. | 62/394 X |
| 3,333,438 | 4/1967 | Benua et al. | 222/146.1 X |
| 3,341,077 | 9/1967 | Gordon | 222/146.6 X |
| 3,360,956 | 1/1968 | Gordon | 62/395 X |
| 3,698,603 | 10/1972 | Radcliffe | 222/146.6 X |
| 3,822,565 | 7/1974 | Arzberger | 62/394 X |
| 3,881,901 | 5/1975 | Williams | 62/394 X |
| 4,629,096 | 12/1986 | Schroer et al. | 222/146.6 |
| 4,721,232 | 1/1988 | Federighi | 222/196.5 |
| 4,779,426 | 10/1988 | Desrosiers | 222/146.6 X |
| 4,792,059 | 12/1988 | Kerner et al. | 222/146.1 X |
| 5,172,832 | 12/1992 | Rodriguez, Jr. et al. | 222/185 X |
| 5,192,004 | 3/1993 | Burrows | 222/146.6 X |
| 5,246,141 | 9/1993 | Burrows | 222/146.6 X |

*Primary Examiner*—Kevin P. Shaver

*Attorney, Agent, or Firm*—Kelly Bauersfeld & Lowry

[57] ABSTRACT

An improved bottled water station is provided of the type having a removable reservoir for drop-in installation into and lift-out removal from a station housing. The reservoir is constructed from a lightweight molded plastic or the like to have an open upper end for receiving and supporting an inverted water bottle. A bottom wall on the reservoir includes an upwardly recessed portion defining an inverted receiver cup for slide-fit reception of an upstanding chiller probe provided as part of a refrigeration system on the station housing. A vent path is provided to vent the space between the chiller probe and the receiver cup during drop-in installation or lift-out removal of the reservoir. However, when the reservoir is seated in a fully installed position, the vent path is closed and a vapor seal prevents air circulation into the space between the chiller probe and the receiver cup, to correspondingly prevent undesired formation of condensation and/or frost. One or more faucet valves are provided to extend through openings in a front wall of the station housing for dispensing water from the reservoir.

11 Claims, 4 Drawing Sheets

BOTTLED WATER STATION WITH REMOVABLE RESERVOIR

BACKGROUND OF THE INVENTION

This invention relates generally to improvements in bottled water stations of the type adapted to receive and support a water bottle in an inverted position, and to selectively dispense water therefrom. More specifically, this invention relates to an improved bottled water station of the type having a removable water-containing reservoir adapted for simple drop-in installation into a station housing. The reservoir and station housing include means for substantially eliminating or preventing formation of undesired condensation and/or frost on the exterior of the water reservoir while facilitating sliding drop-in installation and lift-out removal of the reservoir.

Bottled water dispenser stations are well-known in the art for containing a supply of relatively purified water in a convenient manner and location ready for substantially immediate dispensing and use. Such bottled water stations commonly include an upwardly open reservoir mounted on a station housing and adapted to receive and support an inverted water bottle of typically three to five gallon capacity. Water within the inverted bottle flows downwardly into the station reservoir for selective dispensing therefrom through one or more faucet valves on the front of the station housing. Such bottled water stations are widely used to provide a clean and safe source of water for drinking and cooking, especially in areas where the local water supply is suspected to contain undesired levels of contaminants.

In bottled water stations of the above-described type, the water bottles are normally provided by a vendor in a clean and preferably sterile condition with an appropriate sealed cap to prevent contamination of the water contained therein. When an inverted bottle on a station housing reaches an empty condition, the empty bottle can be lifted quickly and easily from the station housing and replaced by a filled bottle having the sealing cap removed therefrom or otherwise opened. The empty bottle can then be returned to the bottled water vendor for cleaning and refilling.

Although bottled water stations of this type utilize a sequence of water bottles which have been individually sanitized, the water reservoir within the station housing has not been subjected to periodic cleaning or replacement. In this regard, the housing reservoir typically comprises a metal or ceramic tank mounted within the station housing in association with a refrigeration system having a chiller coil for maintaining water within the reservoir in a chilled condition. In some station housing designs, the reservoir is subdivided into distinct chambers, one of which is associated with a refrigeration system, to provide separately dispensed supplies of chilled water and room temperature water. Still further, in other designs, an auxiliary reservoir is provided in association with suitable heated elements to produce a heated water supply. Unfortunately, the integration of the station housing reservoir with associated chilling and/or heating systems has generally precluded easy access to or removal of the reservoir from the station housing for cleaning purposes. Instead, the water-containing reservoir has typically been used for prolonged time periods without cleaning, thus creating the potential for undesired growth of harmful bacteria and other organisms. Reservoir cleaning has generally been accomplished in the past by taking the station out of service and returning the station to a centralized facility for cleaning purposes.

In one proposed construction for a bottled water station, a removable reservoir container has been suggested for drop-in placement and lift-out removal with respect to a supporting chiller plate mounted within a station housing. See, for example, U.S. Pat. No. 4,629,096. While this configuration beneficially facilitates removal of the reservoir container for cleaning purposes, significant problems have been encountered with respect to formation of condensation and/or frost in the space between the removable reservoir container and the refrigerated chiller plate. As a result, such bottled water stations have encountered significant drip problems requiring inclusion of a drip tray, and often resulting in undesirable water puddling on the floor beneath the station housing. Condensate dripping onto carpeted or tiled floor areas in a typical in-home or office environment is, of course, extremely undesirable.

In an alternative and improved bottled water station construction having a drop-in, lift-out reservoir, an upstanding chiller probe within the bottled water station is adapted for slide-fit sealed reception through an opening formed in a bottom wall of the reservoir. See, for example, U.S. Pat. No. 5,192,004. In this construction, the chiller probe is positioned within the interior volume of the removable reservoir, in direct contact with water contained therein, whereby problems relating to condensation and/or frost are entirely avoided. However, an adequate and reliable slide-fit seal arrangement must be provided between the reservoir bottom wall and the chiller probe to prevent undesired water leakage.

In another alternative bottled water station design, a chiller probe within the bottled water station is positioned for slide-fit reception into an inverted receiver cup formed in the bottom wall of the removable reservoir. See, for example, copending U.S. Ser. No. 064,923, filed May 24, 1993, entitled BOTTLED WATER STATION WITH REMOVABLE RESERVOIR. In this configuration, slide-fit seal arrangements were not required since the chiller probe does not protrude through the reservoir bottom wall. A vapor seal is provided to prevent air circulation into the small space between the chiller probe and the receiver cup to control and/or prevent frost and condensation. However, during drop-in installation of the reservoir, residual air within this space is compressed to resist reservoir movement to a fully installed position. Similarly, upon lift-out removal of the reservoir, a vacuum is drawn in this space to resist reservoir removal.

The present invention relates to further improvements in a bottled water station of the type having a drop-in and lift-out reservoir with an inverted receiver cup for slide-fit reception of a chiller probe, in combination with a vapor seal to reduce or eliminate condensation and frost. The bottled water station of the present invention further includes means for venting the space between the probe and the receiver cup during reservoir installation and removal to facilitate sliding reservoir movement.

SUMMARY OF THE INVENTION

In accordance with the invention, an improved bottled water station includes a removable reservoir for drop-in, slide-fit installation into a station housing, and for receiving and supporting a water supply bottle in an inverted position. The reservoir may be constructed from a lightweight molded plastic or the like, and includes a bottom wall having an upwardly recessed portion defining an inverted receiver cup for slide-fit reception of an upstanding chiller probe provided as part of a refrigeration system on the station housing. Vapor seal means are provided to prevent air circulation into the space between the chiller probe and the receiver cup, thereby substantially preventing and/or eliminating formation and/or accumulation of condensation and frost. However, vent means are also provided to vent the space between the chiller probe and the receiver cup during drop-in installation and lift-out removal of the reservoir. The vent means includes a valve plug for closing the vent when the reservoir is fully installed.

The vapor seal means comprises a seal ring carried on the removable reservoir in a position disposed generally at the lower entrance end of the receiver cup. The seal ring, in one preferred form, defines a lip seal for slide-fit engagement with the chiller probe which protrudes upwardly through a support platform and insulation panel for reception into the reservoir receiver cup.

The space between the receiver cup and probe is vented unless the reservoir is fully seated on the probe within the station housing. The vent means includes a path defined by a vent tube extending through the probe to permit air ingress to the space between the receiver cup and probe as the reservoir is installed into or removed from the station housing, thereby facilitating reservoir installation and removal. However, the valve plug is disposed on the reservoir within the receiver cup to engage and close the end of the vent tube when the reservoir is fully installed. The valve plug thus cooperates with the vapor seal means to prevent air circulation into the space between the receiver cup and probe.

Other features and advantages of the present invention will become more apparent from the following detailed description, taken in conjunction with the accompanying drawings which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENT

Figure 1:
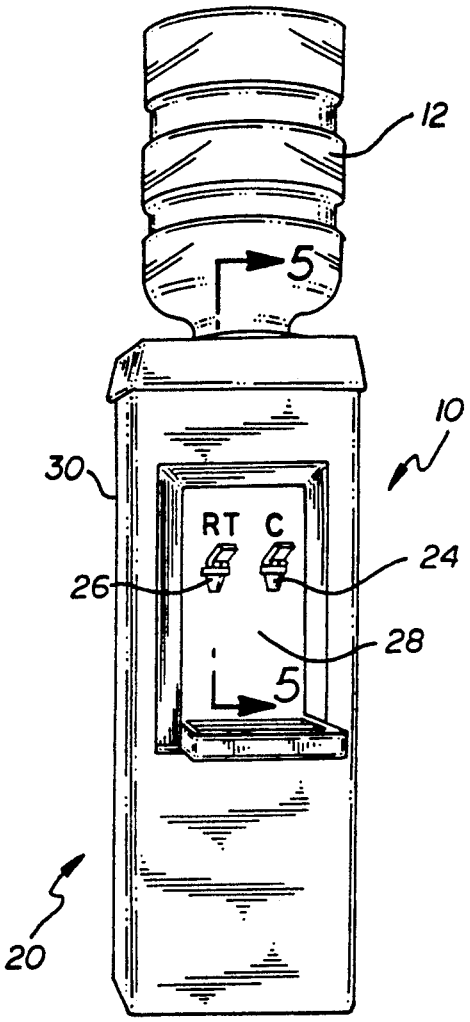
FIG. 1 is a front perspective view illustrating a bottled water dispenser station adapted for use with a removable reservoir of a type embodying the novel features of the invention.
Figure 4:
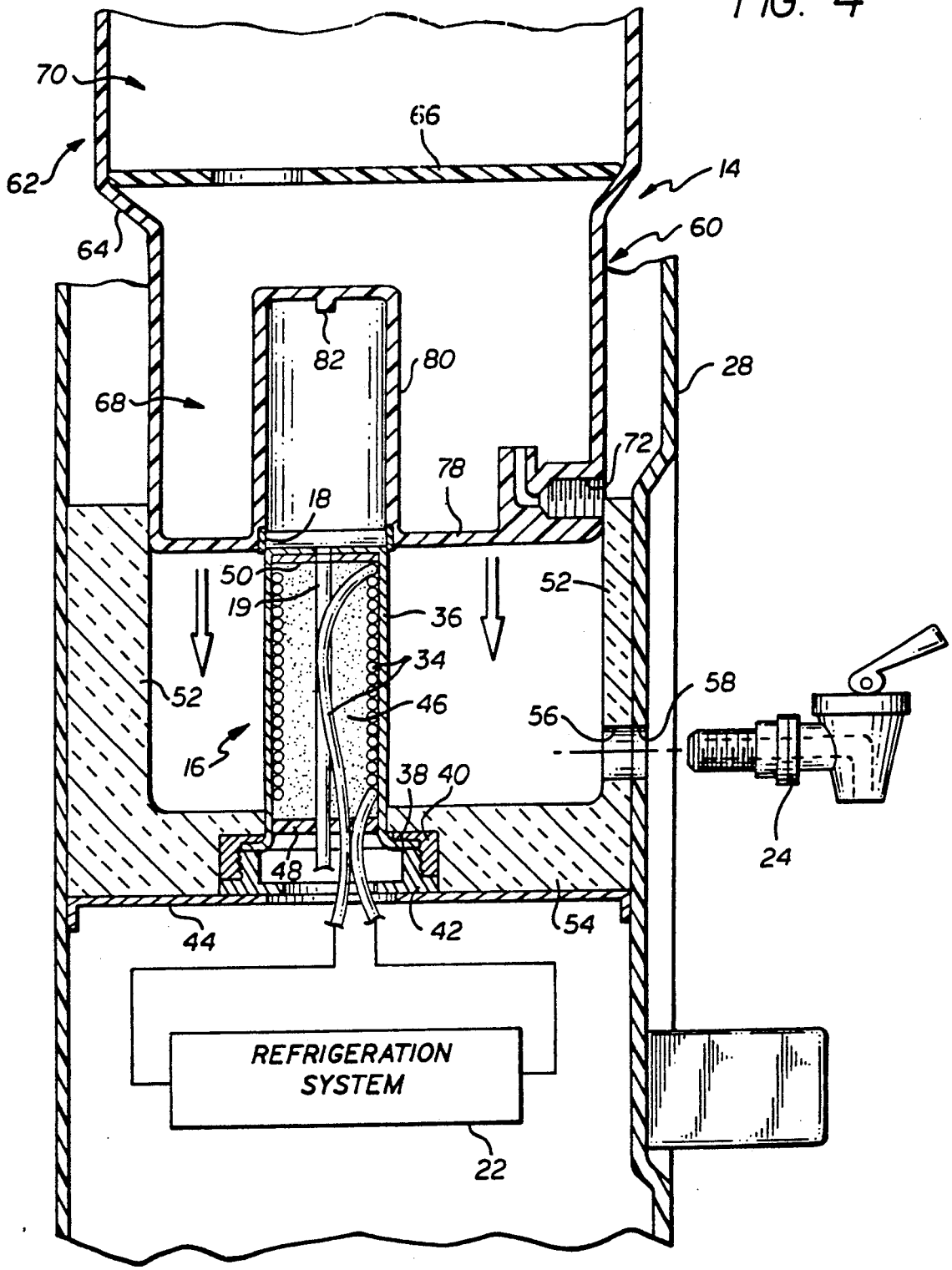
FIG. 4 is an enlarged fragmented vertical sectional view illustrating slide-fit, drop-in installation of the reservoir of FIG. 3 into the station housing.
Figure 5:
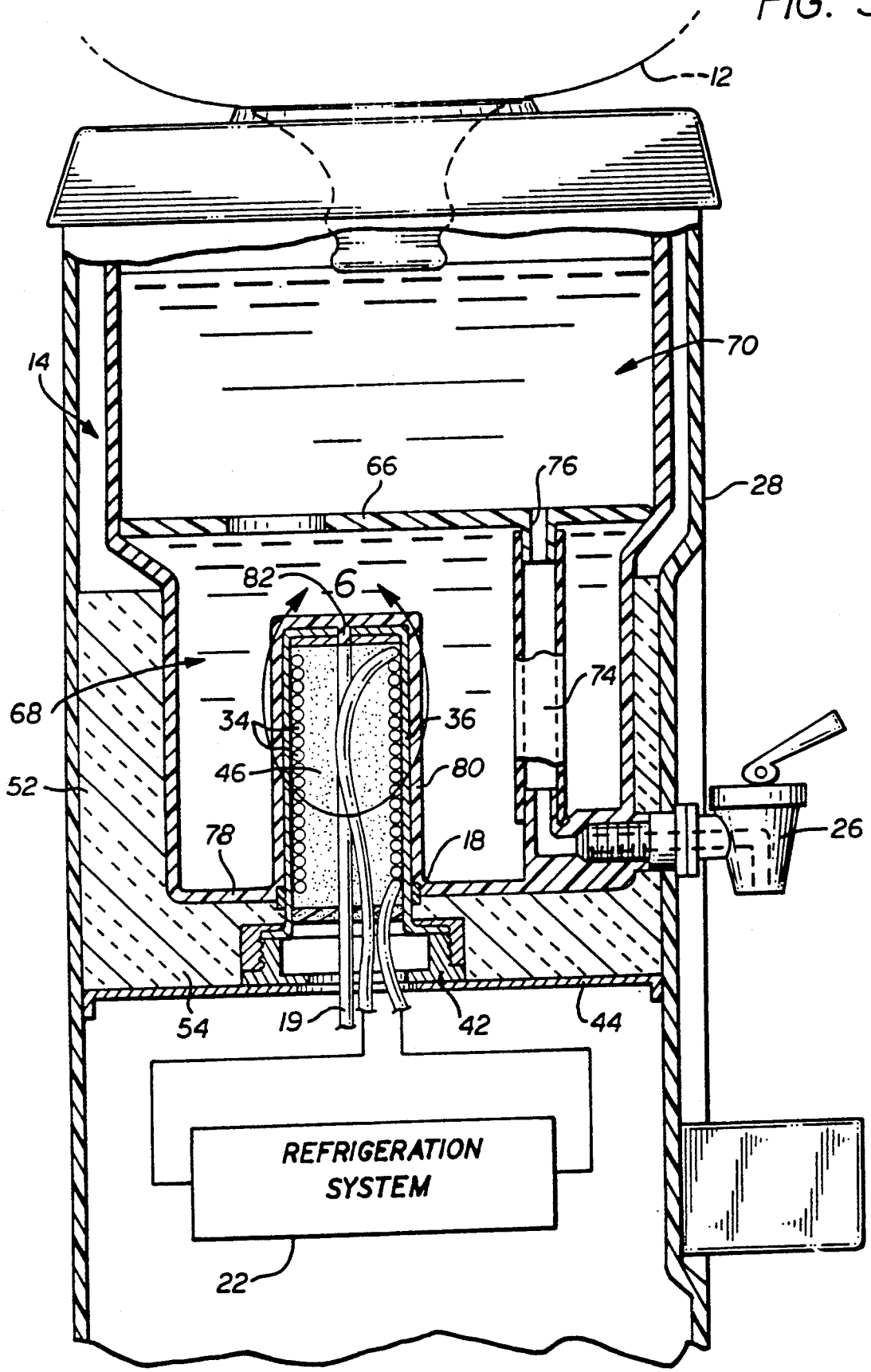
FIG. 5 is an enlarged fragmented sectional view taken generally on the line 5—5 of FIG. 1, and illustrating the removable reservoir installed into the station housing.
Figure 6:
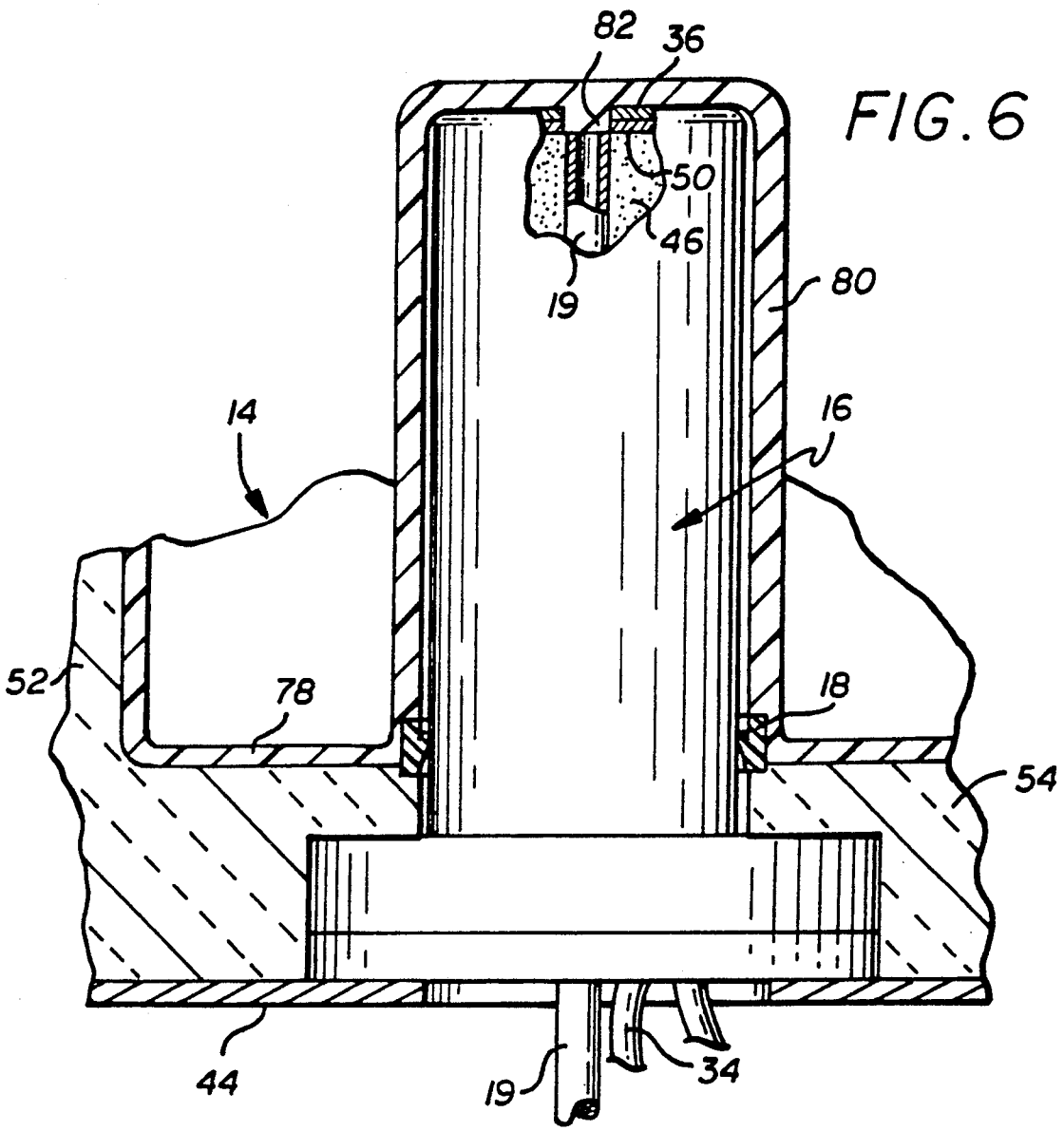
FIG. 6 is an enlarged fragmented sectional view corresponding generally with the encircled region 6 of FIG. 5.

As shown in the exemplary drawings, a bottled water station referred to generally in FIG. 1 by the reference numeral 10 is provided for receiving and supporting a water bottle 12 containing a supply of relatively purified water for drinking and cooking uses, etc. The bottled water station 10 includes a removable reservoir 14 (FIGS. 3–5) adapted for drop-in installation into and slide-out removal from the bottled water station 10, thereby permitting quick and easy removal of the reservoir 14 for cleaning and replacement. The reservoir 14 is designed for slide-fit engagement with an upstanding chiller probe 16 (FIG. 2) within the bottled water station for chilling water within the removable reservoir 14. A vapor seal 18 (FIGS. 3–6) prevents air circulation into the space between the reservoir 14 and the chiller probe 16 when the reservoir is in a fully installed position, thereby substantially preventing or eliminating undesired formation and/or accumulation of condensation or frost. However, during drop-in reservoir installation or slide-out reservoir removal, this space between the chiller probe 16 and the reservoir is vented via a vent tube 19 (FIGS. 2, and 4–6) to facilitate easy reservoir movement.

The illustrative bottled water station has a generally conventional overall size and shape to include an upstanding cabinet or housing 20. This station housing 20, in combination with the removable reservoir 14 to be described in more detail, supports the water bottle 12 in an inverted orientation such that water contained therein will flow downwardly by gravity into the reservoir 14. The chiller probe 16 is provided as part of a refrigeration system 22 (FIGS. 4 and 5) for reducing the temperature level of water contained within at least a portion of the reservoir 14 to a chilled and refreshing beverage temperature, typically on the order of about 40–50 degrees Fahrenheit. The water within the reservoir is adapted for quick and easy dispensing from one or more faucet valves mounted in accessible positions on a front wall 24 of the station housing 20. The exemplary drawings show two faucet valves 24 and 26 for respectively dispensing chilled water and water at a temperature corresponding substantially to room temperature.

Figure 2:
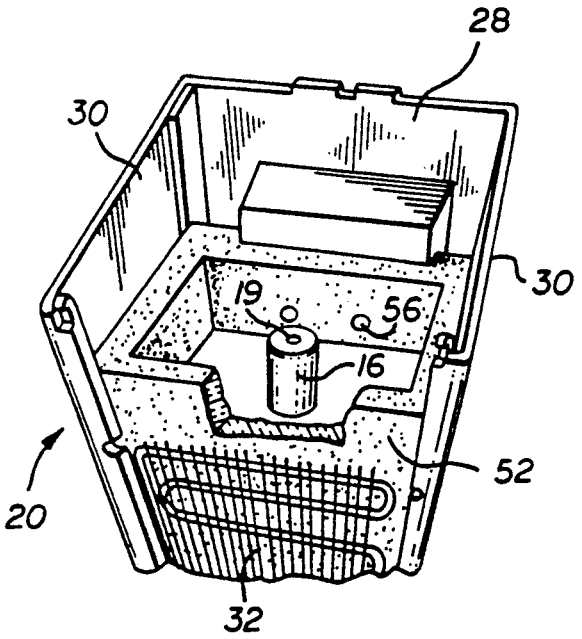
FIG. 2 is an enlarged rear perspective view of the station housing, with the removable reservoir separated therefrom.
Figure 3:
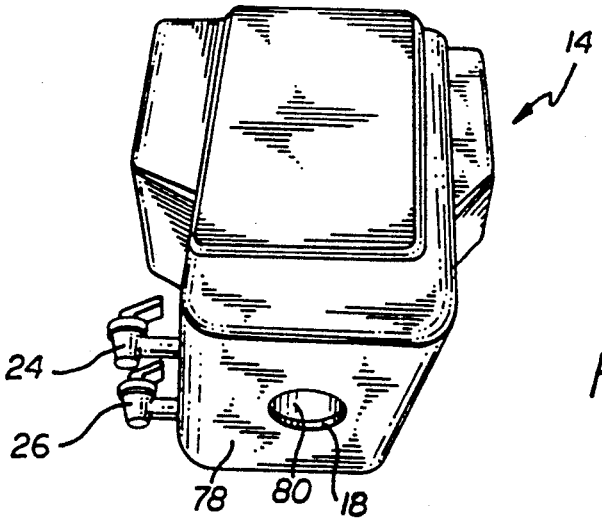
FIG. 3 is an enlarged bottom perspective view depicting one preferred form of the removable reservoir of the present invention.

With reference to FIGS. 1–3, the station housing 20 is shown to have an upstanding, generally rectangular configuration to include the front wall 28 joined to a pair of housing side walls 30, and a housing back which has a typically open construction (FIG. 2). The refrigeration system 22 is normally mounted within a lower portion of the housing interior and comprises a conventional compressor (not shown) for circulating a refrigerant through a closed loop cycle including, for example, finned heat transfer tubing 32 mounted across the open back of the station housing 20. A chiller coil 34 (FIGS. 4 and 5) of copper tubing or the like is wrapped within the interior of an inverted, generally cup-shaped probe shell 36. The probe shell includes an outwardly radiating lower flange 38 retained by a mounting ring 40 on a collar 42 which is supported in turn on a horizontally oriented support platform 44 within the station housing. The chiller probe 16 thus protrudes upwardly from the support platform 44, with the chiller coil 34 wrapped spirally therein.

In the preferred form, the residual volume of the interior of the probe shell 36 is occupied by a thermal mastic material 46 in the form of a viscous or gel material chosen for relatively efficient heat transfer properties, such as a polymeric heat transfer compound of the type marketed by Presstite Division of Inmont Corporation, St. Louis, Mo., under the name Presstite Thermal Mastic. A retainer disk 48 of foam material or the like can be press-fitted into the lower end of the probe shell 36 to ensure retention of the mastic material 36 therein.

In addition, in the preferred form, the probe shell 36 is formed from a lightweight molded plastic material. The thermal mastic material 46 promotes sufficient heat transfer between the coil 34 and the plastic probe shell 36, to obtain satisfactory water chilling as will be described in more detail. A heat transfer plate 50 of a metal such as copper may be installed within the probe shell 36 at the top of the coil 34, in close thermal contact with the top of the probe shell, and has been found to provide significantly further improved heat transfer between the coil 34 and the water within the reservoir.

Insulation panels 52 of closed cell styrofoam or other suitable insulative material are arranged within the station housing 20 in an upwardly open, generally rectangular or box-like receptacle. These insulation panels include a floor panel 54 rested on the support platform 44, with the chiller probe 16 protruding upwardly therefrom, in combination with four upstanding side walls which line the rectangular interior of the station housing. The insulation panels are designed for thermally insulating a lower portion of the removable reservoir 14, wherein chilled water is retained within this lower portion of the reservoir, as will be described in more detail. A pair of faucet ports 56 (FIG. 2) are formed in the one of the insulation panels 52 lining the front wall 28 of the housing, in alignment with corresponding faucet ports 58 in said front wall 28, to accommodate mounting of the faucet valves 24 and 26.

The removable reservoir 14 may be constructed conveniently and economically from a lightweight molded plastic or the like, such as polyethylene with an overall size and shape for relative snug-fit reception into the station housing. In this regard, the reservoir 14 includes a lower portion identified by reference arrow 60, of reduced cross-sectional geometry for relatively snug-fit reception into the box-like structure defined by the insulation panels 52. An upper portion 62 of the reservoir 14 has an expanded cross-sectional size to define an outwardly protruding transition shoulder 64 (FIGS. 4 and 5) upon which a perforated baffle plate 66 can be installed within the reservoir interior. The baffle plate subdivides the interior of the reservoir into a lower chamber 68 and an upper chamber 70. A pair of faucet fittings 72 are provided at a front wall of the reservoir for thread-in mounting of the faucets 24, 26. As shown best in FIGS. 4 and 5, one of the faucet fittings 72 is in direct flow communication with the lower reservoir chamber 68, whereas the other faucet fitting is in flow communication with the upper reservoir chamber 70 via a hollow standpipe 74 which extends upwardly through a port 76 in the baffle plate 66.

A bottom wall 78 of the removable reservoir 14 is configured for slide-fit engagement with the upstanding chiller probe 16, when the reservoir is slide-fit installed into the station housing 20. More particularly, the bottom wall 78 of the reservoir 14 includes an upwardly recessed portion defining an inverted receiver cup 80 having a size and shape for relatively close-fit, press-in reception of the chiller probe 16. The probe 16 may be designed for minor lateral movement relative to the mounting ring 40 and collar 42 to facilitate self-aligned probe reception into the receiver cup. The receiver cup 80 thus defines an upstanding cylindrical wall having an upper end closed by a circular end wall, such that the cup 80 protrudes into the volumetric space of the lower reservoir chamber 68, without providing any open flow port. The close-fit relation between the probe 16 and the receiver cup 80 provides efficient thermal communication for chilling water within the lower reservoir chamber 68, permitting the probe shell 36 to be formed of metal or plastic.

The vapor seal 18 is provided to prevent air circulation into the residual space between the chiller probe 16 and the reservoir walls defining the receiver cup 80, when the reservoir 14 is fully seated and installed into the station housing. As shown in FIGS. 3–6, the vapor seal 18 comprises a seal ring carried within the receiver cup 80 at a location generally at or near the lower open end thereof. The seal ring includes a resilient inwardly radiating lip seal for slide-fit engagement with the exterior of the probe 16 as the reservoir is installed into or removed from the station housing. In the fully installed position, the bottom of the reservoir 14 rests substantially flush on the insulation floor panel 54 (FIGS. 5 and 6), and the seal ring 18 is disposed substantially at the upper surface of the floor panel 54. Alternate seal ring configurations may be used, such as those described and claimed in copending Ser. No. [Docket 33828], which is incorporated by reference herein.

The vapor seal 18 functions, particularly when closed cell foam is used for the insulation panels, to prevent air circulation between the refrigerated exterior surface of the chiller probe 16 and the interior surface of the receiver cup 80. With this construction, formation of condensate and/or frost, and particularly accumulation thereof, at the interface between the probe 16 and the reservoir 14 are substantially prevented. Thus, dripping problems encountered in the prior art with respect to accumulation of condensation or frost are substantially avoided.

In accordance with a primary aspect of the invention, the vent tube 19 defines a vent path for venting the space between the receiver cup 80 and the probe 16 unless and until the reservoir 14 is fully seated within the station housing. More particularly, as shown, the vent tube 19 extends through the probe 16 to a location beneath the support platform 44, to vent the space between the receiver cup and probe as the reservoir is installed or removed. This vent path thus facilitates reservoir installation by preventing air compression within the cup-probe space as the reservoir is moved downwardly during drop-in installation. Similarly, the vent path prevents a vacuum from being drawn in this space as the reservoir is moved upwardly during lift-out removal. When the reservoir is fully installed, however, a valve plug 82 on the receiver cup 80 engages the upper end of the vent tube 19 to close the vent path. Thus, the valve plug 82 cooperates with the seal ring 18 to prevent air circulation to the space between the cup and probe.

A variety of further modifications and improvements to the invention will be apparent to those skilled in the art. Accordingly, no limitation on the invention is intended by way of the foregoing description and accompanying drawings, except as set forth in the appended claims.

What is claimed is:

1. A water station, comprising:

a reservoir having a hollow interior for receiving and storing a supply of water, said reservoir having a bottom wall with an inverted receiver cup formed therein;

a station housing having support means for receiving and supporting said reservoir;

a chiller probe mounted within said station housing and projecting upwardly from said support means for slide-fit reception into said receiver cup when said reservoir is mounted within said station housing, said chiller probe defining a chilled surface for contacting said reservoir to chill water within said reservoir;

vapor seal means for preventing air circulation between said receiver cup and said chiller probe when said reservoir is mounted within said station housing;

vent means including means defining a vent path communicated with the space between said receiver cup and said chiller probe, and valve means for closing said vent path when said reservoir is mounted into said station housing; and faucet means for dispensing water from said reservoir.

2. The water station of claim 1 said means defining a vent path comprises a vent tube extending through said probe, and further wherein said valve means for closing said vent path comprises a valve plug on said receiver cup, said valve plug being engageable with said vent tube to close said vent path when said receiver is in a fully installed position within said station housing.

3. The water station of claim 1 wherein said housing support means defines an upwardly open cavity for drop-in installation and slide-out removal of said reservoir.

4. The water station of claim 1 including insulation means within said cavity and defining an upwardly open insulated receptacle for receiving at least a portion of said reservoir.

5. The water station of claim 4 wherein said vapor seal means comprises a seal ring formed on said reservoir.

6. The water station of claim 1 wherein said vapor seal means comprises a seal ring mounted on said reservoir generally at a lower end of said receiver cup and defining a radially inwardly projecting seal lip for engagement with said probe when said reservoir is mounted within said station housing.

7. The water station of claim 1 wherein said reservoir is adapted to receive the supply of water from an inverted water bottle mounted on said station housing.

8. The water station of claim 1 wherein said station housing includes a front wall having at least one faucet port formed therein, and further wherein said reservoir has a front wall with at least one faucet fitting mounted thereon in a position for general alignment with said faucet port when said reservoir is mounted within said station housing, said faucet means including a faucet removably mounted through said faucet port to said faucet fitting.

9. The water station of claim 1 wherein said chiller probe comprises a probe shell having a temperature control element therein, and a thermal heat transfer material within said probe shell substantially filling the residual space between said temperature control element and said probe shell.

10. The water station of claim 9 wherein said temperature control element comprises a chiller coil.

11. The water station of claim 9 wherein said probe shell is formed from a plastic material.

* * * * *